United States Patent [19]

Rivers

[11] 4,113,480

[45] Sep. 12, 1978

[54] METHOD OF INJECTION MOLDING POWDER METAL PARTS

[75] Inventor: Ronald D. Rivers, Kokomo, Ind.

[73] Assignee: Cabot Corporation, Kokomo, Ind.

[21] Appl. No.: 748,821

[22] Filed: Dec. 9, 1976

[51] Int. Cl.[2] ..... B22F 3/14

[52] U.S. Cl. ..... 75/214; 75/211; 75/222; 264/63; 264/111

[58] Field of Search ..... 75/223, 211, 214, 222; 264/63, 111

[56] References Cited

U.S. PATENT DOCUMENTS

| | | | |
|---|---|---|---|
| 2,979,401 | 4/1961 | Szymaszek | 264/63 X |
| 3,222,435 | 12/1965 | Mellen et al. | 264/63 |
| 3,285,873 | 11/1966 | Bailey | 264/63 |
| 3,309,434 | 3/1967 | Blum et al. | 264/63 |
| 3,330,892 | 7/1967 | Herrmann | 264/63 |
| 3,346,680 | 10/1967 | Bush | 264/63 |
| 3,796,564 | 3/1974 | Taylor et al. | 264/63 |
| 3,859,405 | 1/1975 | Horton | 264/63 X |
| 3,953,562 | 4/1976 | Hait et al. | 264/63 |

*Primary Examiner*—Richard E. Schafer
*Attorney, Agent, or Firm*—Jack Schuman; Joseph J. Phillips

[57] ABSTRACT

Parts are formed from metal powder by mixing the powder with a plastic medium comprising an organic binder dissolved in a solvent in which it is soluble at room temperature but in which it is substantially less soluble at a higher temperature such that the plastic binder becomes viscous at that temperature. Binder modifiers may be incorporated to promote mold release and promote healing of interfaces within the molded part and prevent the formation of drying cracks. The plastic mixture is injected under pressure into a closed die preheated to the above mentioned higher temperature, whereby the rejection of solvent and increase in viscosity of the plastic medium produces a compact sufficiently self-supporting to hold its molded shape and be ejected from the die. The compact is then dried to evaporate the remaining solvent, thus leaving interconnecting pores in the compact for the escape of gases resulting from subsequent burning out of the binder during the sintering operation.

9 Claims, No Drawings

METHOD OF INJECTION MOLDING POWDER METAL PARTS

This invention relates to processes for compacting metal powders. It is more particularly concerned with the injection molding of articles from metal powders.

It is conventional to produce articles of metal powders, particularly of high performance alloys, sometimes called "super alloys", by filling a die with powder mixed with a binder, compacting it under pressure to produce a self-supporting green compact, so-called, ejecting the compact from the die and then sintering the compact so provided. The binder is volatilized or burned out before or during sintering. Such processes are limited in that density gradients through the article are difficult to eliminate. Density gradients in conventionally produced parts arise from particle-to-particle and particle-to-die-wall friction, and bring about non-uniform shrinkage in the sintered part. Because of this, conventionally produced articles seldom have length-to-diameter ratios greater than 2:1. Furthermore, those processes are not readily adapted to provide undercut parts or to produce articles having cored aperatures. Coring in conventionally produced articles is limited to the pressing direction. Transverse coring interferes with particle flow during the die filling and compaction.

Injection molding of plastics is widely employed. In such processes, because of the fluid-like flow of the material, density gradients are avoided. In injection molding withdrawal cores through the mold cavity may be positioned in virtually any direction. It would be advantageous to produce articles of metal powder by injection molding, and for such process thermo-plastic and thermo-setting resins would appear to be suitable binders. However, in order to make the metal powder flow to fill a die cavity, the entire void volume of the metal powder must be filled with some plastic medium. As the tap densities of metal powders range from about 50% to about 65%, depending on the particle size, configuration and the method of production, the volume of plastic medium incorporated would be considerable, and it must be largely removed to produce articles of densities approaching the as-cast density of the metal. Conventionally bindered and dry compacted metal powders are pressed to green densities ranging from about 60% to 70% of as-cast densities. The volume percent of pores, which are interconnecting throughout the article, provide adequate escape passage for burn-out gases. Molded articles produced by injection molding as above described are non-porous, however, and it is very difficult if at all possible, to burn out the plastic medium without blistering or cracking the article.

It is an object of my invention to provide a process of injection molding an article of metal powder adapted for sintering without blistering or cracking. It is another object to provide such a process which will produce articles having a length-to-diameter ratio greater than 2. It is another object to provide such a process employing a plastic medium which flows during injection molding, but which when heated becomes sufficiently viscous to hold the metal powder together in the shape of the die so that it can be ejected therefrom. It is still another object to provide a process employing a plastic medium comprising a suitably modified binder dissolved in a solvent which evaporates prior to sintering of the compact. Other objects of my invention will appear in the course of the description thereof which follows.

My process comprises mixing the metal powder with a plastic medium comprising an organic binder and modifiers, where required, dissolved in a solvent, the organic binder having the property of dissolving in the solvent at room temperature, but of decreasing in solubility at a moderately higher temperature. The mixture of powder and plastic medium in such proportion to have the properties of a fluid is injected under pressure into a closed die which is heated and maintained at a constant temperature at which the plastic medium increases in viscosity. The resulting compact is then held together by the plastic medium so that it can be ejected from the die. The heated die causes rejection of some of the solvent and further oven heating of the ejected compact volatilizes the solvent, leaving a network of pores in the compact and a film of binder in contact with the powder particles. When the compact is sintered, the organic binder volatilizes or sublimes and escapes through the pores of the compact before the powder coalesces so that a dense article results, free from blisters or cracks.

The solvent which I prefer is water and the organic binder I prefer is methyl cellulose, which is soluble in cold water but becomes less soluble in hot water, that is, at temperatures of about 170° to 190° F. The viscosity increase during injection molding is caused by the rejection of water molecules from the surfaces of the long thread-like polymer molecules. During this part of the process some of the solvent is rejected from the compact.

Modifiers are required to promote mold release and complete healing of interfaces within the molded part to prevent drying cracks from forming. A combination of glycerin and boric acid has been found to accomplish this. Both are water soluble and boric acid is soluble in glycerin. Glycerin is a well-known plasticizer for methylcellulose, and enhances mold release. The plasticization enhances the interface healing, but it is not completely effective without the boric acid, thus, it is a synergistic combination.

The plastic medium and solvent combination above described is effective over a considerable range of variations of content of its components. For optimum results, with atomized powders, the solvent should comprise around 60% by weight of the plastic medium composition.

The maximum green density of the molded and dried part is dependent on the tap density of the metal powder being used. A clean, dry, inert gas-atomized, −325 mesh powder of the composition above mentioned has a tap density of about 63% to 65% of as-cast density. If the 35% to 37% void volume of that powder is filled with plastic medium and the powder is injection molded, the green density of the molded article will be comparable to the tap density of the powder.

In carrying out my process I dry blend methyl cellulose powder with the metal powder. Glycerin and boric acid are put into solution in the water, which is warmed, and that solution is added to the mixed powder. The resulting plastic mass is injected at room temperature into a closed die which has been heated to about 190° F., and is subjected to a pressure of about 4 tons per square inch on the injection cylinder. When the metal powder is −325 mesh atomized powder the resulting compact has a green density of about 64% of as-cast density. The compact is dried for a few hours at about 220° F. to 250° F. and then exhibits a transverse rupture strength of about 2400 pounds per square inch.

As I have mentioned, the above drying of the compact vaporizes water, leaving the remainder of the plastic medium as a continuous film around the metal powder particles and a considerable volume of interconnected pores throughout the compact. The compact is then sintered in a reducing atmosphere or vacuum, the heating causing substantially all of the continuous film to vaporize and escape through the pores before sintering causes the metal powder grains to coalesce. It should be mentioned that the boric acid broadens, and lowers, the sintering temperature range for certain alloys such as the super alloys.

A typical plastic medium for −325 mesh atomized metal powder, expressed in percentage of the weight of the metal powder is:

| | |
|---|---|
| Methyl Cellulose | 2.0% |
| Glycerin | 1.0% |
| Boric Acid | 0.5% |
| Water | 4.5% |

Desirable ranges of plastic media for atomized powder of from −30 to −325 mesh sizes are:

| | |
|---|---|
| Methyl Cellulose | 1.5 to 3.5% |
| Glycerin | 0.25 to 2.0% |
| Boric Acid | 0.1 to 1.0% |
| Water | 4.0 to 6.0% |

Ball milled powder of −325 mesh can also be injection molded using plastic media as above described. However, because of the higher surface area and irregular shape of the ball milled particles, about twice the weight of solvent is required to wet particle surfaces in order to obtain a workable mix. The green densities of the resulting parts are in the range of 48 to 50% of as-cast density.

Mechanical properties of conventionally pressed and sintered bars and test bars made by the method of my invention hereindescribed and sintered are tabulated below.

The super alloy had the following nominal composition, in percentage by weight:

| Cr | W | C | Ni | Si | Fe | Mn | MO | Co |
|---|---|---|---|---|---|---|---|---|
| 27.0-31.0 | 3.5-5.5 | 0.90-1.40 | 3* | 1.5* | 3.0* | 1.0* | 1.5* | Bal. |

*Maximum

Column A is the average value of three lots of the alloy of −325 mesh atomized powder conventionally pressed with 3% polyvinyl alcohol binder and sintered. Column B is an identical powder injection molded by my process hereindescribed with the typical plastic medium hereinbefore set out.

| | A | B |
|---|---|---|
| Green Density, % | 68.0 | 65.0 |
| Sintered Density, % | 98.7 | 99.5 |
| Sintered Hardness, Rc | 38–39 | 41–43 |
| Ult. Strength, psi | 141,333 | 146,500 |
| Elongation, % | 2.6 | 2.5 |

By the method of my invention hereindescribed I have injection molded a bar 0.75 inch square and 10 inches long with a single injection port located at the center of the bar. This was equivalent to forming two 5 inch long bars at the same time, each having a length-to-diameter ratio of 6.6:1. No non-uniformity in sintering shrinkage was experienced, and no blistering or cracking was observed.

In the foregoing specification I have described presently preferred embodiments of my invention; however, it will be understood that my invention can be otherwise embodied within the scope of the following claims.

I claim:

1. A method of forming self-supporting compacts from metal powder, which formed compacts have green densities substantially equal to the tap density of the metal powder and being adapted for sintering without blistering or cracking by injection molding, comprising (1) mixing the metal powder with a plastic medium in an amount sufficient to substantially fill the entire void volume of the metal powder, thereby forming a plastic mixture, the plastic medium comprising an organic binder dissolved in a solvent in which it is soluble at room temperature but in which it is substantially less soluble at a higher temperature such that the plastic medium increases in viscosity at higher temperatures by rejection of the solvent, (2) injecting the plastic mixture under pressure at room temperature into a closed die preheated to that higher temperature, whereby solvent is rejected from the mixture and the rejection of solvent and increase in viscosity of the plastic medium produces a compact sufficiently self-supporting to hold its molded shape and to be ejected from a die cavity (3) removing the compact from which solvent has been rejected from the die and (4) drying the ejected compact to remove the remaining solvent therefrom and leave interconnecting pores in the compact for the escape of gases resulting from subsequent burning out of the binder during the sintering operation.

2. The method of claim 1 in which the metal powder is a high performance superalloy.

3. The method of claim 1 in which the plastic medium is composed of a binder, a solvent and binder modifiers.

4. The method of claim 3 in which the binder is methyl cellulose, and the solvent is water.

5. The method of claim 4 in which the modifiers are glycerin and boric acid.

6. The method of claim 3 in which the solvent is more than about 50% by weight of the plastic medium.

7. The method of claim 3 in which the metal powder is ball milled powder of −325 mesh and the plastic medium comprises, by weight of the metal powder, 1.5% to 3.5% methyl cellulose, 0.25% to 2.0% glycerin, 0.1% to 1.0% boric acid and 8% to 12% water.

8. The method of claim 3 in which the metal powder is atomized powder of between −30 and −325 mesh, and the plastic medium comprises, by weight of the metal powder, 1.5% to 3.5% methyl cellulose, 0.1% to 1.0% boric acid, 0.25% to 2.0% glycerin and 4.0% to 6.0% water.

9. The method of claim 8 in which the plastic medium comprises, by weight of the metal powder, about 2% methyl cellulose, about 0.5% boric acid, about 1.0% glycerin and about 4.5% water.

* * * * *